US006439100B1

(12) United States Patent
Jung et al.

(10) Patent No.: US 6,439,100 B1
(45) Date of Patent: Aug. 27, 2002

(54) BULLETPROOF EQUIPMENT

(76) Inventors: Tae Suk Jung, 1423-5, Backsuck-dong, Ilsan-gu, Koyang-shi Kyeunggi-do 411-360; Yong Bon Ku, Government Employees' Apartments 810-1206, Hwon-dong Kangnam-Gu, Seoul 135-230, both of (KR)

( * ) Notice: Subject to any disclaimer, the term of this patent is extended or adjusted under 35 U.S.C. 154(b) by 0 days.

(21) Appl. No.: 09/903,311

(22) Filed: Jul. 11, 2001

(30) Foreign Application Priority Data

Jul. 11, 2000 (KR) ..... 00-39520

(51) Int. Cl.[7] ..... F41H 5/06

(52) U.S. Cl. ..... 89/36.01; 89/36.02; 89/36.04; 89/36.05

(58) Field of Search ..... 89/36.01, 36.04, 89/36.05, 36.07, 36.02, 36.17

(56) References Cited

U.S. PATENT DOCUMENTS

| | | | | | |
|---|---|---|---|---|---|
| 4,782,735 | A | * | 11/1988 | Mui et al. | 102/303 |
| 5,578,784 | A | * | 11/1996 | Karr et al. | 89/36.03 |
| 5,739,458 | A | * | 4/1998 | Girard | 89/36.02 |
| 6,029,558 | A | * | 2/2000 | Stevens et al. | 89/36.17 |
| 6,279,449 | B1 | * | 8/2001 | Ladika et al. | 89/36.02 |

* cited by examiner

*Primary Examiner*—Michael J. Carone
*Assistant Examiner*—Gabriel Sukman
(74) *Attorney, Agent, or Firm*—Klauber & Jackson

(57) ABSTRACT

A bulletproof equipment for protecting personnel against a projectile fired from a gun or the like. The equipment includes a inflatable bulletproof air bag for protecting a targeted individual from fire of a weapon; an air tank for ejecting compressed gas or air into the air bag; a high speed fan for feeding air into the air bag when the air bag is punctured; a controller for controlling the associated components; and a power supply for applying electric current.

16 Claims, 6 Drawing Sheets

140

BULLETPROOF EQUIPMENT

BACKGROUND OF THE INVENTION

1. Field of the Invention

The present invention relates to bulletproof equipment for protecting personnel against a projectile fired from a weapon, such as a hand gun, a machine gun or the like. More particularly, the present invention relates to protective bulletproof air bag equipment that can be used for protecting individuals who are particularly at risk of violence by a criminal or terrorist, such as a leading head of state.

2. Description of the Prior Art

In the prior art, conventional bulletproof equipment, such as a bulletproof shield, a bulletproof podium, or the like, has been used to protect key figures from perilous situations, such as sniper fire and terrorist attack. Individuals at risk face particular vulnerability during public appearances and/or at festivities, and such conventional bulletproof equipment can and has been overcome by criminals and terrorists alike.

As such conventional bulletproof equipment has not been capable of providing broad and comprehensive protective capability, there is particular vulnerability in preparation for continuing second and third attacks in public appearances and/or festivities. Considering that such attacks can be the cause of the collapse of social law and order, there is a need for improvement.

In particular, since such existing bulletproof equipment is limited in its employment, development of new special equipment having more comprehensive protective capability is required.

For example, a conventional assault jacket and a bulletproof bag for use by a bodyguard, requires prompt action by the bodyguard in order to effectively cope with a perilous situation; the requires amount of time required for the bodyguard's reaction can be critical.

In addition, a conventional bulletproof podium and table adapted to be used in festivities would provide only a partial concealing space for a targeted individual.

In another solution, backlighting is used as auxiliary means for preventing terrorist's attacks is only in a restrictive place such as an indoor festivity, so that the backlighting disturbs the visibility of a terrorist. However, this solution hardly gives substantial bulletproof effect in a truly perilous situation.

When it is necessary to temporarily set up a soundproof wall or a barrier for accomplishing another purpose, such a sound proof wall or the barrier, requires a long time to set up and take down, and cannot be reused.

In addition to key figures at risk, soldiers sometimes encounter enemy forces and do not have access to cover trenches for protection. Such soldiers are at increased risk to be killed because they are exposed to fire from enemies. Therefore, there remains a need to develop personal portable protective equipment.

SUMMARY OF THE INVENTION

Accordingly, the present invention has been made in order to fulfill the need in the prior art. Accordingly, the present invention provides a novel and unobvious means for protecting key personnel during various public and semi-public festivities.

At least one aspect of the present invention is to provide a barrier means for temporary use in a construction site.

Another aspect of the present invention is the provision of a personal bulletproof shield for being carried by soldiers on a battlefield.

In order to accomplish the above provisions, the present invention is a bulletproof equipment comprising: a bulletproof air bag for protecting a targeted individual from fire of a weapon at a certain ceremony; an air tank for ejecting compressed gas or air into the air bag to inflate the air bag within a predetermined time period by remote control of a user; a high speed fan for feeding air into the air bag to restore the deflated air bag to its original shape when the air bag is punctured by firing from a weapon; a controller for controlling a solenoid operated valve of the air tank, the high speed fan and a driving motor of the bulletproof air bag; and a power supply for applying electric current to the solenoid operated valve, the high speed fan and the driving motor of the air bag.

The bulletproof air bag may be made of high-strength polyethylene having weight not greater than ⅓ of that of Kevlar, which includes Preglight, Dyneema and Spectra.

The bulletproof air bag comprises an inner layer, an outer layer and an intermediate layer disposed therebetween, and the inner layer, the intermediate layer and the outer layer can be made of a windshield cloth, Preglight yarn and Flex, respectively.

The air bag has a front surface similar to that of a blanket and an inverted U-shape in a sectional profile when inflated. In addition, the air bag is capable of protecting a key figure by providing a barrier including the outer layer, the intermediate layer, the inner layer, an air layer, the inner layer, the intermediate layer and the outer layer in this order, upon experiencing impact of a bullet.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1A:
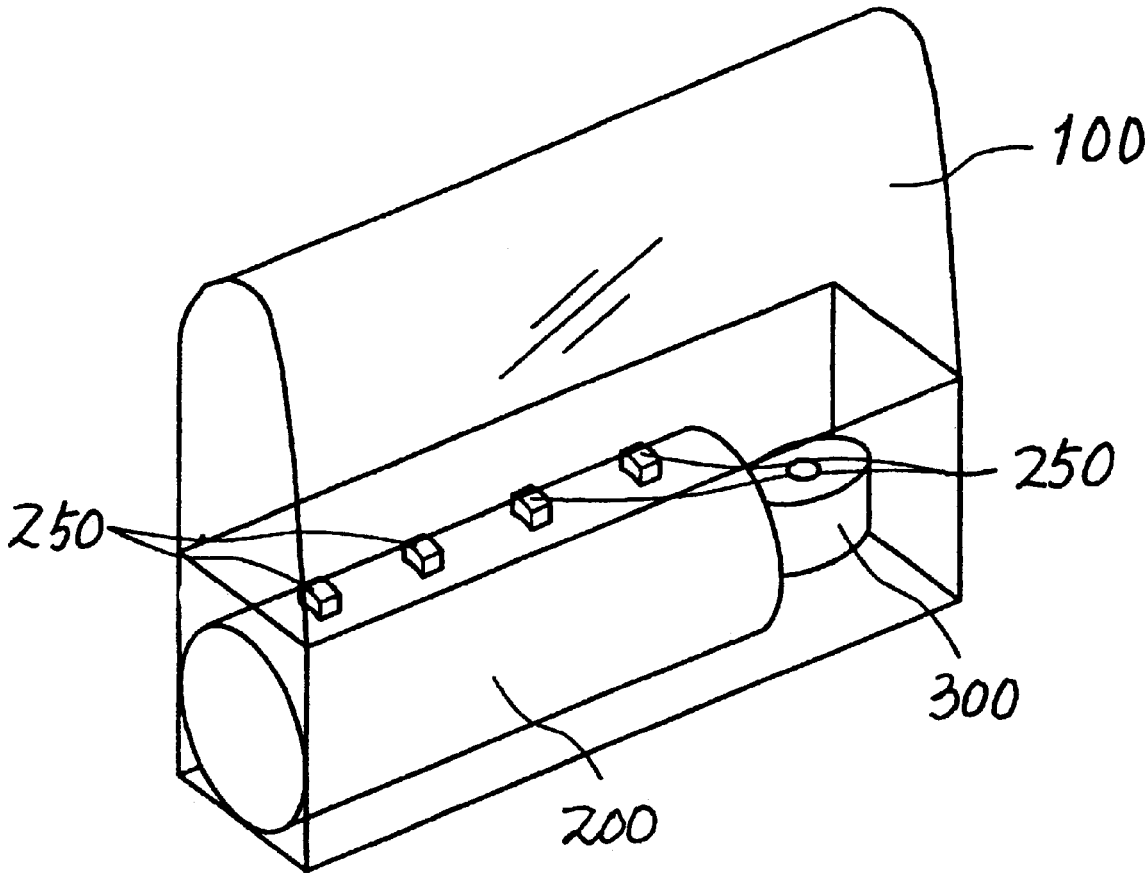
FIG. 1A illustrates a perspective view showing a bulletproof air bag device according to the present invention.

Reference now should be made to the drawings, in which the same reference numerals are used throughout the different drawings to designate the same or similar components. It should be understood by persons of ordinary skill in the art that the drawings are provided for illustration and not limitation, and the present invention may include variations not shown in such drawings which are within the spirit of the invention and the scope of the appended claims.

First Embodiment

Figure 1B:
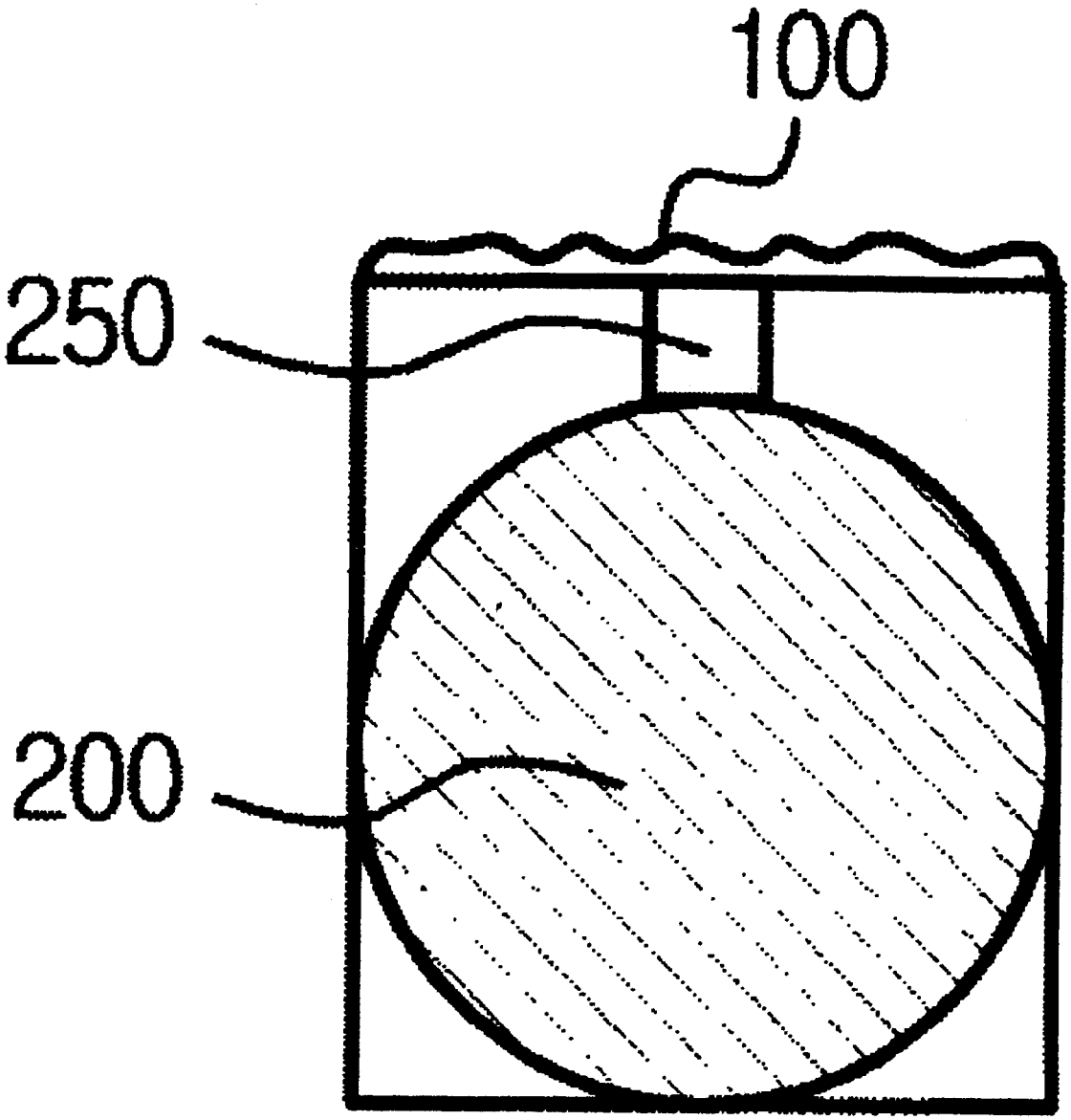
FIG. 1B is a cross section of the lower portion of the device in FIG. 1A which illustrates the air tank.

As shown in FIG. 1A, an embodiment of the bulletproof equipment according to the present invention includes a bulletproof air bag 100 for protecting a targeted individual from fire from a weapon at a certain ceremony, an air tank 200 for ejecting a compressed gas or air into the air bag 100 to inflate the air bag within a predetermined time period by remote control of a user, a high speed fan 300 for feeding air into the air bag 100 to restore the deflated air bag to the original shape when the air bag 100 is punctured by firing from a gun, a controller 400 (shown in FIG. 5) for controlling a solenoid valve 250 of the air tank 200 (a cross section of which is shown in FIG. 1B). In this embodiment, the high speed fan 300, a driving motor of the bulletproof air bag 100, and the solenoid valve 250 are supplied electric current by power supply 500.

Figure 1C:
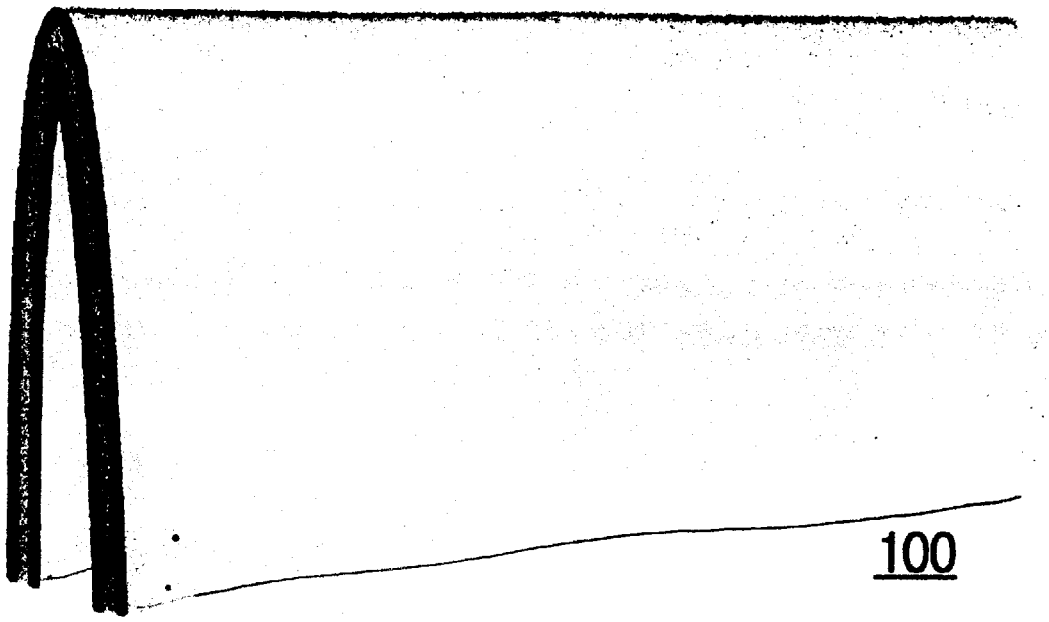
FIG. 1C is a sectional view of the upper portion of the device shown in FIG. 1A showing the air bag when inflated.

As previously mentioned, it is envisioned that the bulletproof air bag 100 can be embedded at a lower portion of a podium. The air bag 100 has a front surface similar to that of a blanket and an inverted U-shape in a sectional profile when inflated (as shown in FIG. 1C).

Figure 2:
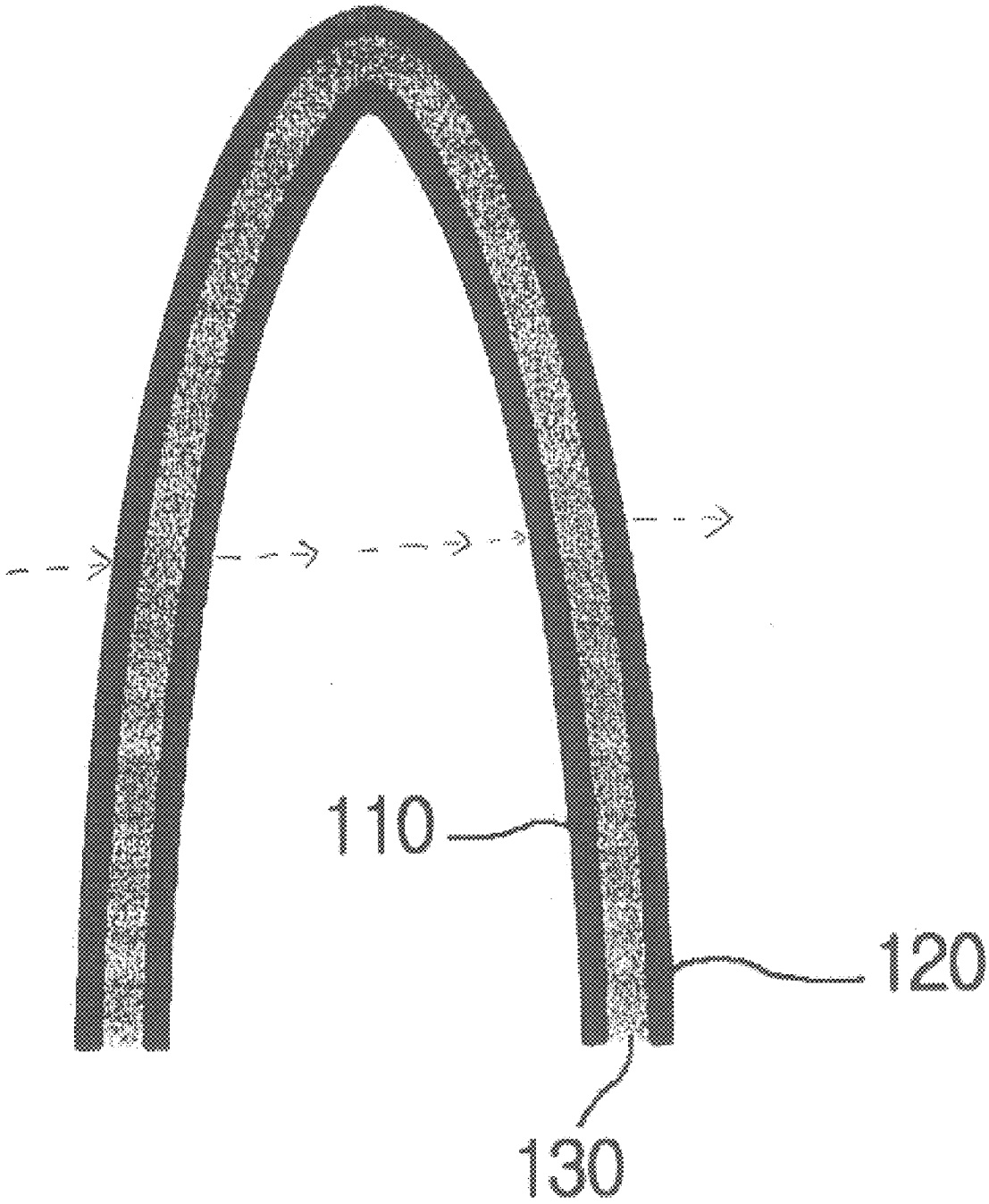
FIG. 2 illustrates a sectional side view of FIG. 1.

FIG. 2 shows that the bulletproof air bag 100 comprises an inner layer 110, an outer layer 120 and an intermediate layer 130 disposed therebetween. In a best mode of the present invention, the inner layer is made of a windshield cloth, the intermediate layer is made of Preglight yarn, and the outer layer is made of Flex. Persons of ordinary skill in the art might find substitute material for one or more of the layers, but the disclosed materials are the best known by the inventors.

The air bag 100 contains gas or air injected therein, which protects an individual by the barrier comprised of the outer layer, the intermediate layer, the inner layer, the gas and/or air layer, the inner layer, the intermediate layer and the outer layer in this order, upon experiencing impact of a bullet. In other words, the path of a projectile, as shown by the dashed arrows in FIG. 2, would enter approximately transverse to a longitudinal direction of the airbag. In order for the projectile to reach the intended target, the bullet would need to travel through the above-mentioned path before it could reach an individual. However, because of the multilayer structure and the compressed gas and/or air, the projectile will not be able to penetrate the airbag.

In fact, if the bullet were able somehow to initially pass through the first outer, intermediate and inner layer structure, is velocity would be so severely slowed that with the pressure from compressed gas further deflecting its path, the projectile would not be able to travel through the other side of the airbag. In addition, the high speed fan will provide air into the bag to keep it from deflating. Thus, even if multiple projectiles were fired, the airbag device would still provide protection which heretofore was unknown.

The bulletproof air bag 100 is constructed of high-strength polyethylene having a weight not greater than ⅓ of that of Kevlar. The high-strength polyethylene includes Preglight, Dyneema and Spectra.

The air tank 200 is made from a composite of a stainless steel plate having thickness of 5mm or more and Preglight yarn.

The air tank 200 is also adapted to be embedded in a podium on which the bulletproof equipment is placed. The air tank 200 should pressures to 80 kg/cm$^2$, and its internal pressure is usually under pressure of about 15 kg/cm$^2$ during normal use.

The high speed fan 300 is also adapted to be embedded in a podium, and typically has a height of 350 mm or more and circumference of 250 mm or more. It should be note by persons of ordinary skill that modification of these dimensions are still within the spirit of the invention and scope of the appended claims, and could be modified according to need.

The bulletproof air bag 100 is preferably designed to be operated within a time period of 0.1 second by remote control of an operator 600. It is within the spirit of the invention and the scope of the appended claims that a pressure sensor (not shown) could be arranged inside the airbag, and when the pressure within the airbag decreased (indicating that there is a leak) the controller can automatically activate the high speed fan to increase the air pressure inside the airbag to within a predetermined value.

It is also possible that sensors other than pressure sensor (such as audible sensors, optical sensors, etc.) could be used in addition to, or in place of an operator, particularly sensors that could detect audible sounds corresponding to gunshots, or this hissing sound of compressed air exiting the airbag. An optical sensor could detect when the airbag has changed position beyond a certain value which would indicate a leak in pressure is causing deflation.

The air bag 100 is preferably sized such that it has a height in the range of 150–200 cm, a width of the air layer of 250 mm or more and a width between the outer layer and the inner layer of 3 mm or more and the air bag is adapted to coincide with a lateral length of the podium.

Figure 3:
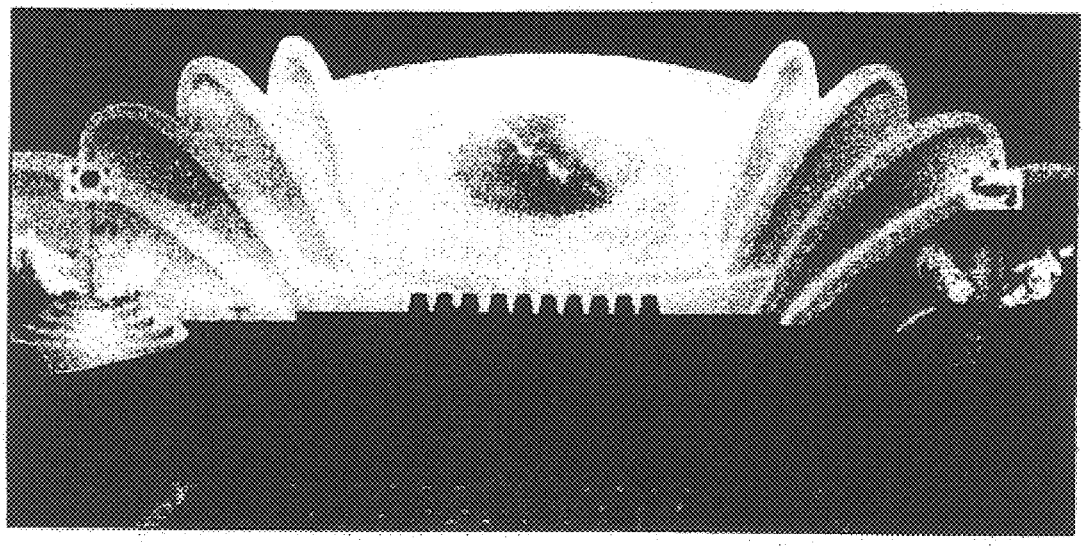
FIG. 3 shows an example of a non-activated stage.
Figure 4:
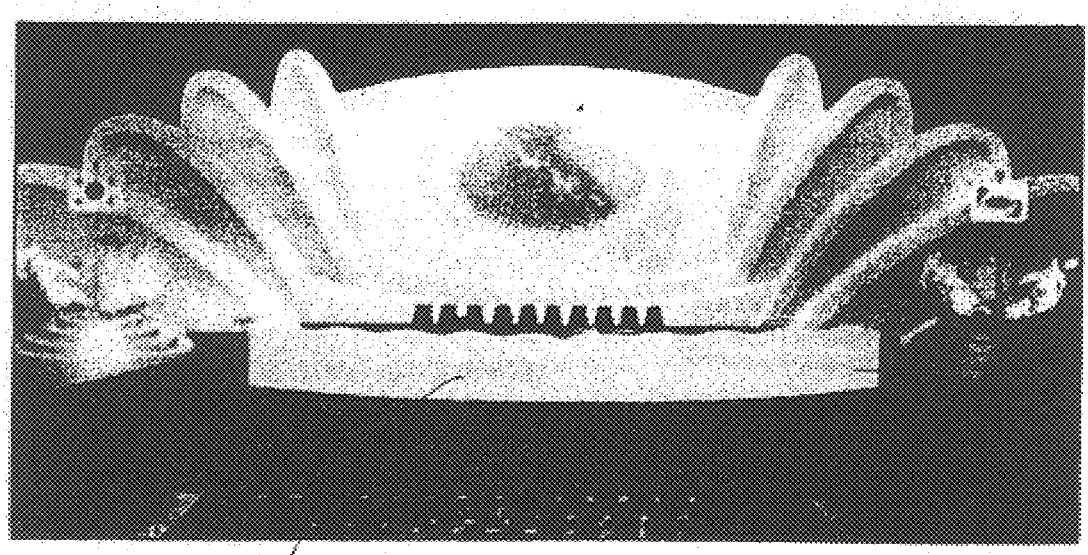
FIG. 4 shows the stage of FIG. 3, having a bulletproof equipment of the invention actuated.

FIGS. 3 and 4 show the airbag device in its usual state and in an actuated state, respectively. The area identified by 140 is that of the gas or air.

Figure 5:
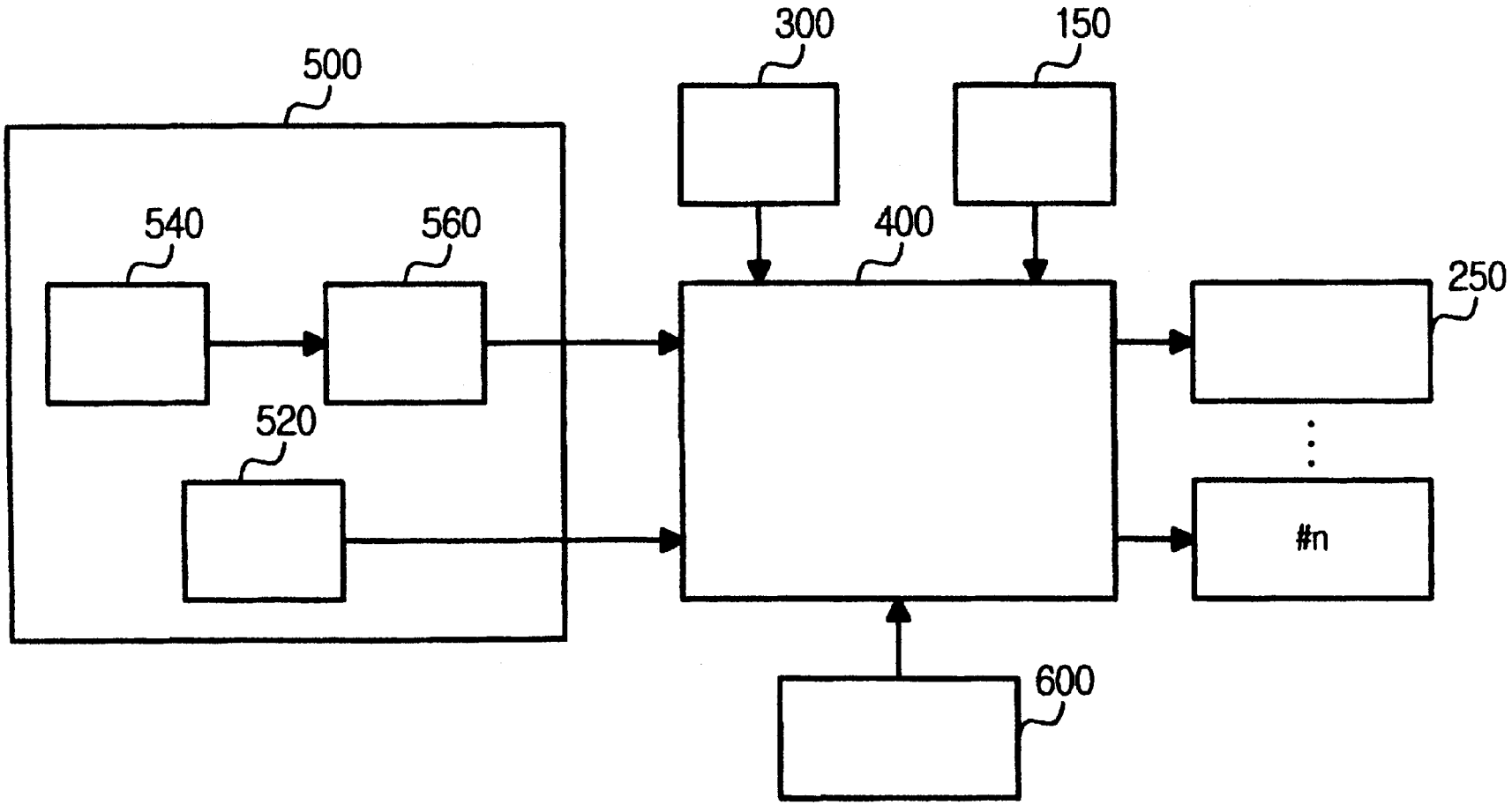
FIG. 5 illustrates an electric circuit diagram showing the bulletproof equipment of the invention.

As shown in FIG. 5, the power supply 500 includes a D/A converter 560 for converting direct current into alternating current. The power supply 500 may supply alternating current in such a way that alternating current is directly supplied from an AC power supply in ordinary use but direct current from a DC power supply 540 can be converted into alternating current and then the converted alternating current is supplied when the alternating current supplying from the AC power supply 520 is cut off.

The compressed gas in the air bag 100 may comprise noncombustible gas such as helium and nitrogen.

The air tank 200 is gas filling type and is reusable.

The bulletproof equipment according to the invention is received in a hexahedral housing disposed in the floor behind a podium. The air tank 200 is equipped with a predetermined number of solenoid valves 250 for ejecting compressed air or gas at high pressure within a predetermined time period.

The windshield cloth 110 of the air bag 100 is coated by vinyl material or the like.

The bulletproof equipment of the invention can be used at a podium in various ceremonies such as commemorative ceremonies, ground-breaking ceremonies, completion ceremonies, dedication ceremonies, and can be at podiums used at a military parade.

The following Table 1 shows test results of the bulletproof equipment of the invention(carried out at a military rifle range).

TABLE 1

| Type of gun | Distance to target | Sheets required to defend against puncture (air bag of the invention) | Sheets required to defend against puncture (a conventional one) |
|---|---|---|---|
| Handgun (P-7 Pistol, 3.8 mm revolver) | 5 M | 10 sheets | 12 sheets |
| Machine gun (MP-5) | 15 M | 12 sheets | |

Second Embodiment

A construction barrier employing a substantial part of the bulletproof equipment of the invention will be now described. The barrier is substantially identical to the bulletproof equipment mentioned above in terms of structure but it is different from the bulletproof equipment in that the construction barrier is not needed for operation in a short time, thereby allowing its structure to be simplified. However, the barrier for construction may be operated promptly, if required. The structure of this embodiment will be easily appreciated by those skilled in the art, based on the disclosure from the first embodiment.

The construction barrier comprises an air bag 100 adapted for use as a wall member used in, for example, civil engineering work or building construction, an air tank 200 for supplying a certain quantity of gas into the air bag 100 to inflate the air bag, a fan unit 300 for feeding air into the air bag 100 to restore the deflated air bag to the inflated shape when the air bag 100 is punctured due to some reason, a controller 400 for controlling a solenoid operated valve of the air tank 200, the fan unit 300 and a driving motor of the air bag 100, and a power supply 500 for applying electric current to the solenoid valve, the fan unit and the driving motor of the air bag, as is the case with the Example 1.

Third Embodiment

A bulletproof shield for military applications employing a substantial part of the bulletproof equipment of the invention will be now described.

The bulletproof shield for military applications comprises a bulletproof air bag 100 functioning as a shield for protecting a soldier from fire of enemies on a battle field without a shield, an air tank 200 for ejecting out compressed gas or air into the air bag 100 to inflate the air bag within a predetermined time period by remote control of the soldier, a high speed fan 300 for feeding air into the air bag 100 to restore the deflated air bag to the original shape when the air bag 100 is punctured by fire of enemies, a controller 400 for controlling a solenoid valve of the air tank 200, the high speed fan 300 and a driving motor of the bulletproof air bag 100, and a power supply 500 for applying electric current to the solenoid valve, the high speed fan and the driving motor of the air bag.

The bulletproof shield for military applications of the present invention is characterized by being portable. In other words, in this embodiment, the shield can be worn or carried by a user.

The power supply 500 is preferably designed to supply direct current and to be rechargeable.

As described above, the present invention provides a bulletproof equipment having various advantages as follows. The equipment can give a broad protective range, that is, the equipment can shield side positions as well as a frontal position of a targeted individual on a platform. The equipment can be operated to inflate the air bag within a time period of 0.1 second. Furthermore, the bulletproof equipment of the invention shows the effect of protection for an extended period of time. Therefore, the protective effect is maintained even after the user takes shelter thereunder.

The bulletproof equipment of the invention has other advantages in that it shows an excellent bulletproof effect by its double wall and can maintain its normal shape persistently (even when the air bag is punctured). In addition, the equipment is reusable(gas filling type), and is adjustable in its size in response to the scale of ceremony.

Although preferred embodiments of the present invention has been described for illustrative purposes, those skilled in the art will appreciate that various modifications, additions and substitutions are possible, without departing from the scope and spirit of the invention as disclosed in the accompanying claims.

What is claimed is:

1. A bulletproof device comprising:

a bulletproof air bag for protecting a targeted individual from a projectile fired from a weapon;

inflation means in communication with the air bag for injecting compressed gas or air into the air bag for inflating the air bag within a predetermined time period;

pressure retention means comprising a high speed fan in communication with the air bag for feeding air into the air bag to retain a pressure in the air bag at a predetermined value so that the airbag retains its inflated shape subsequent to the air bag being punctured;

control means for controlling at least one of an actuation of the inflation means and the retention means, and detection means for detecting a reduction in pressure in the airbag, said detection means providing a feedback signal to said control means with regard to a status of the airbag.

2. The device as set forth in claim 1, in which the bulletproof air bag is made of high-strength polyethylene having weight not greater than ⅓ of that of Kevlar.

3. The device as set forth in claim 1, in which the bulletproof air bag comprises an inner layer, an outer layer and an intermediate layer disposed therebetween.

4. The device according to claim 1, wherein said pressure detection means comprises a pressure sensor which detects a pressure of the airbag.

5. The device according to claim 1, wherein said inflation means comprises a tank having valves that are actuated by said control means.

6. The device according to claim 5, wherein said tank is adapted to be embedded in a floor behind a podium.

7. The device according to claim 1, wherein said control means automatically activates said pressure retention means when the pressure in the airbag is reduced below a threshold value.

8. The device according to claim 1, wherein said control means includes means for manually activating said pressure retention means.

9. The device according to claim 8, wherein said means for manually activating said control means includes a remote control.

10. A bulletproof device comprising:

a bulletproof air bag for protecting a targeted individual from a projectile fired from a weapon;

an air tank in communication with the air bag for injecting compressed gas or air into the air bag to inflate the air bag within a predetermined time period by remote control of a user;

a high speed fan in communication with the air bag for feeding air into the air bag to restore the deflated air bag to its inflated shape subsequent to the air bag being punctured by a projectile;

a controller for controlling a solenoid operated valve of the air tank, the high speed fan and a driving motor of the bulletproof air bag; and a power supply for applying electric current to the solenoid operated valve, the high speed fan and the driving motor of the air bag.

11. The bulletproof equipment as set forth in claim 10, in which the bulletproof air bag is made of high-strength polyethylene having weight not greater than ⅓ of that of Kevlar.

12. The bulletproof equipment as set forth in claim 10, in which the bulletproof air bag comprises an inner layer, an outer layer and an intermediate layer disposed therebetween.

13. A bulletproof shield for military applications comprising:

a bulletproof air bag functioning as a shield for protecting a soldier from fire of enemies on a battle field without a shield;

an air tank for injecting compressed gas or air into the air bag to inflate the air bag within a predetermined time period by remote control of the soldier;

a high speed fan for feeding air into the air bag to restore the deflated air bag to the inflated shape subsequent to the air bag is punctured by fire of enemies;

a controller for controlling a solenoid valve of the air tank, the high speed fan and a driving motor of the bulletproof air bag.

14. The bulletproof shield according to claim 13, further comprising a power supply for applying electric current to the solenoid valve, the high speed fan and the driving motor of the air bag.

15. The bulletproof shield as set forth in claim 13, in which the bulletproof air bag is made of high-strength polyethylene having weight not greater than ⅓ of that of Kevlar.

16. The bulletproof shield as set forth in claim 13, in which the air bag has a front surface having a blanket texture and an inverted U-shape in a sectional profile when inflated, and the air bag protects the intended target by providing a barrier comprising the outer layer, the intermediate layer, the inner layer, the air layer, the inner layer, the intermediate layer and the outer layer, respectively, said barrier being arranged between a path of a bullet and the intended target.

* * * * *